United States Patent [19]

Östbo

[11] 3,990,503

[45] Nov. 9, 1976

[54] REGENERATIVE HEAT EXCHANGER

[76] Inventor: Karl Robert Ambjörn Östbo, Volrat Thamsgatan 4, Goteborg, Sweden, 41278

[22] Filed: May 9, 1974

[21] Appl. No.: 468,631

[30] Foreign Application Priority Data

May 17, 1973 Sweden ..... 7306948

[52] U.S. Cl. ..... 165/9; 165/7; 165/10

[51] Int. Cl.[2] ..... F28D 19/00

[58] Field of Search ..... 165/6, 7, 8, 9, 10

[56] References Cited

UNITED STATES PATENTS

| | | | |
|---|---|---|---|
| 1,958,666 | 5/1934 | Honigmann | 165/8 |
| 2,932,492 | 4/1960 | Lange | 165/9 |
| 2,951,686 | 9/1960 | Sandmann et al. | 165/7 X |
| 3,211,213 | 10/1965 | Baxley et al. | 165/9 |

FOREIGN PATENTS OR APPLICATIONS

| | | | |
|---|---|---|---|
| 1,397,214 | 3/1965 | France | 165/8 |

*Primary Examiner*—Albert W. Davis, Jr.
*Attorney, Agent, or Firm*—Holman & Stern

[57] ABSTRACT

A regenerative air preheater is provided with a rotatable body mounted within a cylindrical casing. The rotatable body is formed by perforated discs mounted upon a shaft, and the casing is subdivided into passages for the air and the gas, respectively, by means of rows of rod members fitted between the discs and extending radially inwards from the casing towards the shaft.

8 Claims, 6 Drawing Figures

REGENERATIVE HEAT EXCHANGER

BACKGROUND OF THE INVENTION

The present invention relates to a regenerative heat exchanger, especially an air preheater, and of the type comprising a rotatable body mounted within a cylindrical casing, which is sub-divided internally to provide at least one passage for a first, heat emitting fluid and at least one further passage for the heat adsorbing fluid. The object of the invention is to provide a simple and inexpensive apparatus, having high heat transferring properties.

SUMMARY OF THE INVENTION

The invention is characterized in that the body is composed of a number of mutually spaced, perforated discs mounted upon a rotatable shaft and that the casing is provided with at least two rows of rod members directed radially inwards from the envelope wall of the casing towards the shaft with at least two such rod members fitting into the inter-space between two adjacent discs, said rows of rods forming partitions between the fluid passages.

DESCRIPTION OF SOME PREFERRED EMBODIMENTS

Figure 1:
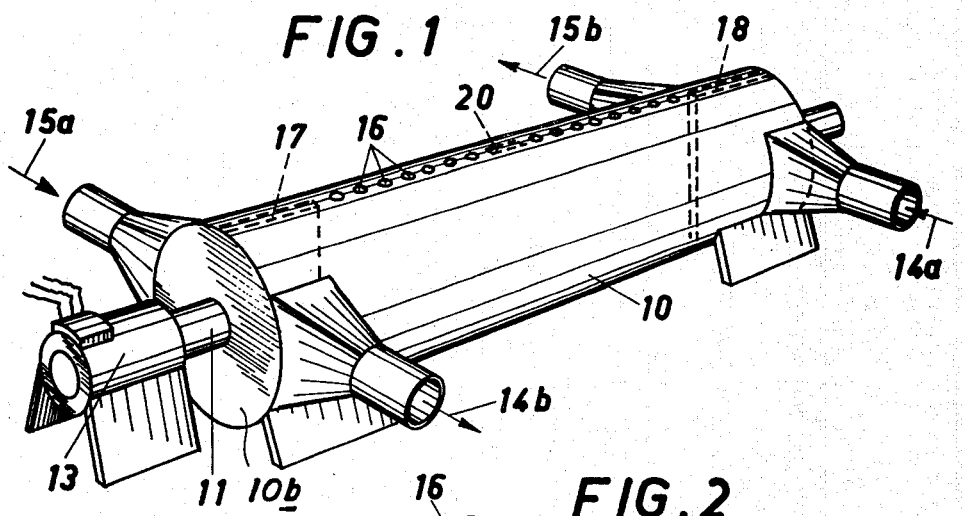
FIG. 1 schematically shows a perspective view of a horizontal air pre-heater according to the invention, having two passages.
Figure 2:
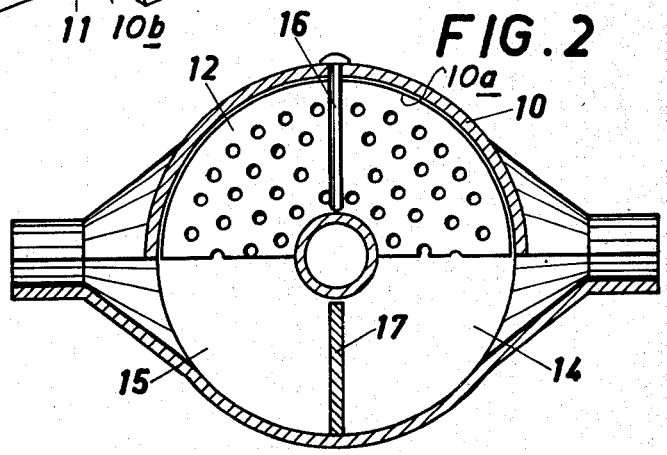
FIG. 2 is a vertical cross section through the air preheater according to FIG. 1, in which the upper half represents a middle portion of the casing, and the lower half represents an end portion thereof.
Figure 3:
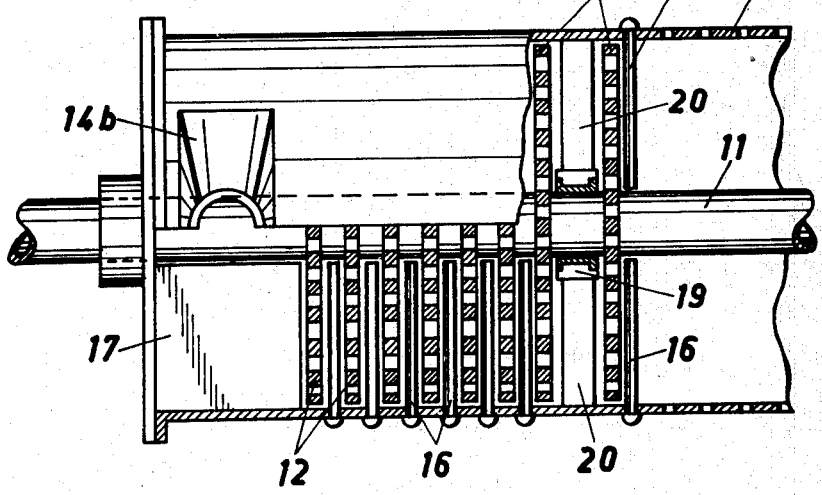
FIG. 3 is an elevation, partly in section, of one end of the air preheater, FIG. 4 schematically shows a vertical air preheater, partly in section, having four passages.

The air preheater shown in FIG. 1 includes a cylindrical casing 10, which concentrically encloses a shaft 11. Upon the shaft a number of perforated discs 12 are fitted at spaced intervals in such a manner that they, together with the shaft, will form a rotatable body. This is, in any suitable manner, driven by a motor 13.

The casing 10 will, in a manner to be described more in detail herebelow, about in a diametral plane, be subdivided into two passages, of which one 14, which is adapted to convey the air to be preheated, is provided with an inlet 14*a* and an outlet 14*b*. The other passage 15, which is adapted to convey the heat emitting gas, is provided with an inlet 15*a* and an outlet 15*b*. The inlets and the outlets are arranged in such a manner that the gases will pass in counter flow through the preheater.

Within the main portion of the casing the two passages 14 and 15, respectively, are separated by two rows of rods 16, which from the wall 10*a* of the casing, extend radially inwards, substantially to the shaft 11. Two diametrically oppositely located rods 16 are fitted between every pair of adjacent discs 12.

The body formed by the discs is somewhat shorter than the casing, whereby free spaces will be formed at each end thereof in communication with the inlets and the outlets of the passages 14 and 15. These spaces are subdivided into distributing and collecting chambers by means of partitions 17 and 18, respectively, forming extensions of the rows of rods 16.

With a long casing, one or more bearings 19 are fitted to carry the shaft between the ends of the casing. These bearings are supported by wall portions 20, which likewise form extensions of the rows of rods and serve to define the passages 14 and 15 between the two discs 12 located to each side of a bearing 19.

The discs may be manufactured from any suitable heat absorbing material and with a thickness permitting the forming of suitable apertures for the flow of the gases. All discs will always have one half within the heat emitting gas stream and its other half in the heat absorbing air stream.

As the discs are continuously rotated, the parts thereof momentarily passing through the stream of hot gases will absorb heat, while the other halves of the same discs, simultaneously passing through the air stream will emit heat, recently absorbed in the other passage, to the air.

The rods 16 extend cantileverwise from the wall 10*a* to the shaft and are shaped and mounted in a manner suited to the size of the air preheater and to the temperatures encountered.

In addition to air preheaters, the invention may be used with other types of heat exchangers, where heat is to be transferred, thus also for cooling purposes, between two streams of gaseous fluids. The rows of rods are shown as located diametrically opposite to each other, whereby the two passages 14 and 15 will obtain about the same cross sectional area. It is, however, evident that it, with certain differences of temperatures between the two fluids, may be advantageous to select a certain angular displacement between the rows, whereby one of the passages will obtain a larger cross sectional area than the other.

The casing has been defined as being cylindrical which, of course, refers to the internal configuration thereof. The external shape of the casing is formed to suit the conduits conveying fluid to the exchanger, and away therefrom, respectively, as well as local conditions.

The casing may be made in halves to be fitted together, or is provided with man-holes, so the rotor body is easily accessible. The shaft may be divided and provided with connecting flanges, so the rotor body, or parts thereof may be easily removed for inspection and then inserted.

Figure 4:
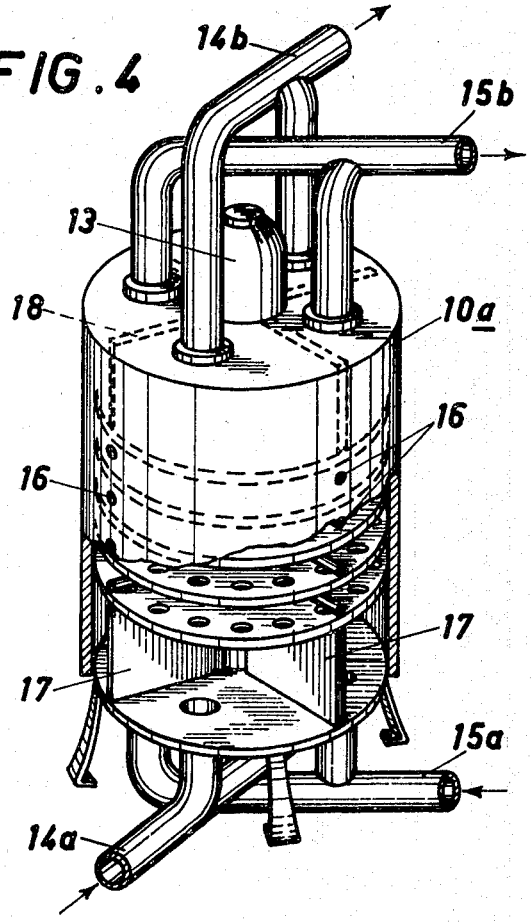

FIG. 4 shows a vertical air preheater having four passages. The casing cylindrical wall is denoted by 10*a* and there are four rows of rods 16 located in two mutually perpendicular, diametrical planes defining the four passages, which are connected to an inlet conduit 14*a* for the air and a conduit 15*a* for the combustion gases in such a manner that two diametrically opposite passages will convey the air, and the two intermediate passages will convey gas. The air and the gas leave the preheater through conduits 14*b* and 15*b*, respectively.

A driving motor 13 is arranged at the top of the casing, and the spaces therein, outside the body of the discs 12 is sub-divided by means of four radial partitions 17. In order to minimize cross flow between the passages, the difference in pressure of the two fluids is kept as low as possible within the casing. To obtain that, the fluids are permitted to flow in the same direction through the casing.

Figure 5:
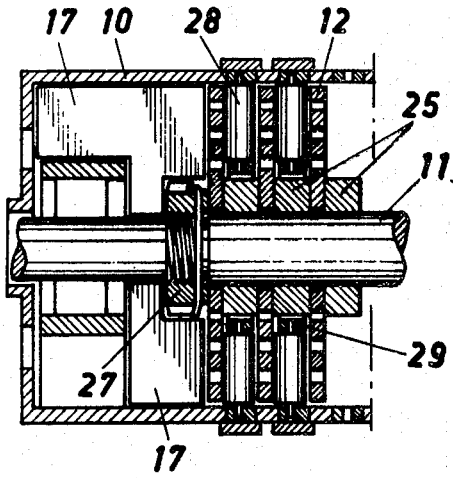
FIGS. 5 and 6 show some modifications of the arrangements for mounting the discs and the rod members. The casing is defined by an internal cylindrical wall 10*a* and end walls 10*b*.
Figure 6:
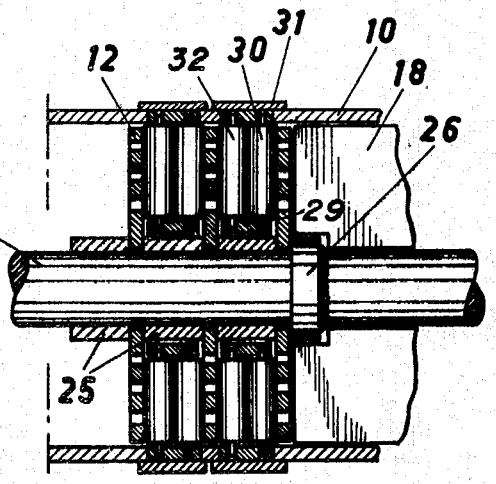

FIGS. 5 and 6 show some different embodiments of the rods and of mounting the discs upon the shaft 11.

As shown in FIG. 5, the individual discs are separated by rings 25 having the desired thickness. The package of discs and rings is pressed towards a collar or flange (26 in FIG. 6) by means of a nut 27, so the discs will be securely located and prevented from angular displacement upon the shaft.

The discs are mounted on the shaft in such a manner that neighboring discs will be angularly displaced with respect to each other, so the fluids do not flow straight through the body, but are forced to perform repeated changes of direction in their paths.

In FIG. 1, the rods extend cantileverwise from the casing to the shaft. In FIG. 5, roller members 28 are used instead of rods. The outer end of a roller is journalled in the casing and its inner end is journalled in a ring 29, which is free-floating with respect to the inner ring 25.

The rod members will, in this manner, be better supported, and will not brake the movement of a disc, with which it occasionally comes into contact.

A still better arrangement providing a higher degree of sealing is obtained with the embodiment according to FIG. 6. Here two rollers 30 and 32 are used to form a rod member with, the rollers being individually journalled in a cover 31 and in an inner, free-floating ring 29, respectively.

The rollers 30, 32 can each have contact with the adjacent disc 12, and both rollers have contact with each other, so they completely close the space between the discs.

As the discs rotate in the same direction, the rollers are brought to rotate in opposite directions, which is desirable with respect to the movement at the interface between the rollers.

What I claim is:

1. In a regenerative heat exchanger, including a casing defined by an internal cylindrical wall, a rotatable body mounted within said casing, said casing being subdivided internally to provide at least one passage for a first, heat emitting fluid and at least one further passage for a second heat absorbing fluid, and a rotatable shaft within said casing, the improvement that the body is composed of a number of mutually spaced, perforated discs mounted upon said rotatable shaft, that the casing is provided with rows of rollers, directed radially inwards from the wall of the casing towards the shaft, at least two rollers fitting into the interspace between two adjacent discs, said rows of rollers forming partitions between the fluid passages, a ring, said ring being free floating with respect to said shaft, and each roller being journalled in said casing and said ring, said casing being longer than the rotatable body, to form a space at each end of said body, and a fixed partition within each space forming an extension of each row of rollers to subdivide each of said spaces into chambers for distributing and collecting the fluids.

2. The heat exchanger according to claim 1, which at least one bearing, supported by wall portions forming extensions of the rows of rollers and extending between discs located to opposite sides of the bearing, carries the shaft between the ends of the casing.

3. The heat exchanger according to claim 1, in which the casing is provided with two rows of rollers, located substantially diametrically opposite to each other to define two passages.

4. The heat exchanger according to claim 1, in which the casing is provided with four rows of rollers, located in two mutually perpendicular, diametrical planes to define four passages.

5. The heat exchanger according to claim 3, in which inlet and outlet conduits for the fluids are connected to the casing in such a manner that the fluids will pass the passages in the same direction.

6. The heat exchanger according to claim 4, in which inlet and outlet conduits for the fluids are connected to the casing in such a manner that the fluids will pass the passages in counter-flow.

7. The heat exchanger according to claim 1, including two parallel rollers fitting into the interspace between two adjacent discs, said two parallel rollers being in contact with each other and with the adjacent discs, respectively, and being journalled in the casing and in said ring.

8. The heat exchanger according to claim 1, including spacer rings about said shaft, a fixed collar on the shaft, the discs being mounted upon the shaft alternatingly with said spacer rings and a nut by which the discs are forced towards said fixed collar to form a package rotatable together with the shaft.

* * * * *